United States Patent [19]

Sen Gupta et al.

[11] 4,362,116

[45] Dec. 7, 1982

[54] METHOD AND SEMI-AUTOMATIC APPARATUS FOR SEWING FLYPIECES TO SLIDE FASTENER CHAIN

[75] Inventors: Sisir K. Sen Gupta; Wayne A. Becker, both of Meadville, Pa.

[73] Assignee: Talon, Inc., Meadville, Pa.

[21] Appl. No.: 214,925

[22] Filed: Dec. 10, 1980

[51] Int. Cl.[3] ..... D05B 3/12

[52] U.S. Cl. ..... 112/265.2; 112/113; 112/121.11

[58] Field of Search ..... 112/265.2, 265.1, 104, 112/113, 121.11

[56] References Cited

U.S. PATENT DOCUMENTS 3,570,104 3/1971 Jensen ..... 29/408
3,765,348 10/1973 Jabor .
4,152,996 5/1979 Van Amburg ..... 112/121.11 X
4,236,292 12/1980 Orr et al. ..... 29/408
4,324,034 4/1982 Berry et al. ..... 29/410

*Primary Examiner*—Peter P. Nerbun
*Attorney, Agent, or Firm*—Anthony A. O'Brien

[57] ABSTRACT

Flypieces are fed by a conveyor to a sewing station in a sewing machine which is operated by a sensor mounted a spaced distance in front of the sewing station to sew the flypieces to a slide fastener chain. The linear rate of feed of the flypieces by the conveyor is slower than the linear rate of feed of the flypiece and slide fastener chain through the sewing station by the sewing machine, and operation and termination of the sewing machine in response to the sensor is delayed so that uniform spacing is produced between flypieces sewn on the slide fastener chain.

12 Claims, 10 Drawing Figures

METHOD AND SEMI-AUTOMATIC APPARATUS FOR SEWING FLYPIECES TO SLIDE FASTENER CHAIN

TECHNICAL FIELD

The present invention relates to methods and apparatus for sewing flypieces to continuous slide fastener chain.

DESCRIPTION OF THE PRIOR ART

The prior art, as exemplified in U.S. Pat. Nos. 3,570,104, 3,765,348 and 4,152,996, contains a number of methods and apparatus for sewing flypieces to continuous slide fastener chain. In one prior art technique, flypieces are fed by a vibrating table to a pair of feed-in rolls which feed the flypieces to a sewing machine which sews the flypieces to a continuous slide fastener chain; the sewing machine is operated by a photocell located about three-fourths of an inch in advance of the sewing needle for stopping and starting the sewing machine in response to the presence of a flypiece. In another apparatus, flypieces are fed by a roller conveyor to a sewing machine where a photocell-lamp combination sensing the flypieces operates the sewing machine to sew the flypieces to a zipper string. In the prior art devices, the sewing of flypieces to the slide fastener chain generally requires two operations, one, the sewing of the flypieces to the chain, and two, the serging of the edge of the flypieces. The two operations can be separate or can be accomplished by two sewing machines operating in tandem. The prior art generally also suffers from one or more deficiencies such as being relatively expensive, not producing uniform spacing between flypieces, not properly aligning flypieces relative to slide fastener chain to which they are being sewn, being incapable of automatically avoiding the sewing of flypieces to spliced sections of slide fastener chain, etc.

SUMMARY OF THE INVENTION

The invention is summarized in a method of sewing flypieces onto a continuous slide fastener chain including the steps of guiding a continuous slide fastener chain to a sewing station defined by a sewing machine; sequentially feeding flypieces along a feed path to the sewing station by means of a conveyor; sensing the presence and absence of a flypiece at a predetermind point in the feed path spaced in front of the sewing station; operating the sewing machine in response to the sensing of the presence of a flypiece at the predetermined point; the operating including advancing the flypieces and slide fastener chain through the sewing station, and sewing the flypieces to the slide fastener chain during the advancing; terminating operation of the sewing machine in response to the sensing of the absence of a flypiece at the predetermined point; the operating and the terminating each including delaying the operating and the terminating, respectively, of the sewing machine for selected durations after first sensing the presence and the absence, respectively, of a flypiece at the predetermined point; the advancing of the flypieces and the slide fastener chain through the sewing station being performed at a first linear feed rate; and the feeding of the flypieces to the sewing station by the conveyor being performed at a second linear feed rate which is less than the first linear feed rate whereby a predetermined uniform spacing is produced between flypieces sewn to the slide fastener chain.

An object of the invention is to sew flypieces onto continuous slide fastener chain inexpensively and reliably with uniform selected spacing between the flypieces.

Another object of the invention is to semiautomate the sewing of flypieces at uniform spacing to slide fastener chain in a manner that reduces the amount of operator skill necessary to produce unifrom spacing between the flypieces.

It is yet another object of the invention to reduce the amount of labor involved in sewing flypieces to slide fastener chain.

One advantage of the invention is that by maintaining constant spacing between flypieces sewn to slide fastener chain, the efficiency of other operations such as gapping are improved; for example, in gapping the operator does not have to double trip the gapping apparatus due to large spaces between flypieces.

An additional feature is the elimination of waste by maintaining uniform narrow spacing between flypieces sewn to slide fastener chain.

Other objects, advantages and features of the invention will be apparent from the following description of the preferred embodiment taken in conjunction with the accompanying drawings.

DESCRIPTION OF THE PREFERRED EMBODIMENT

Figure 1:
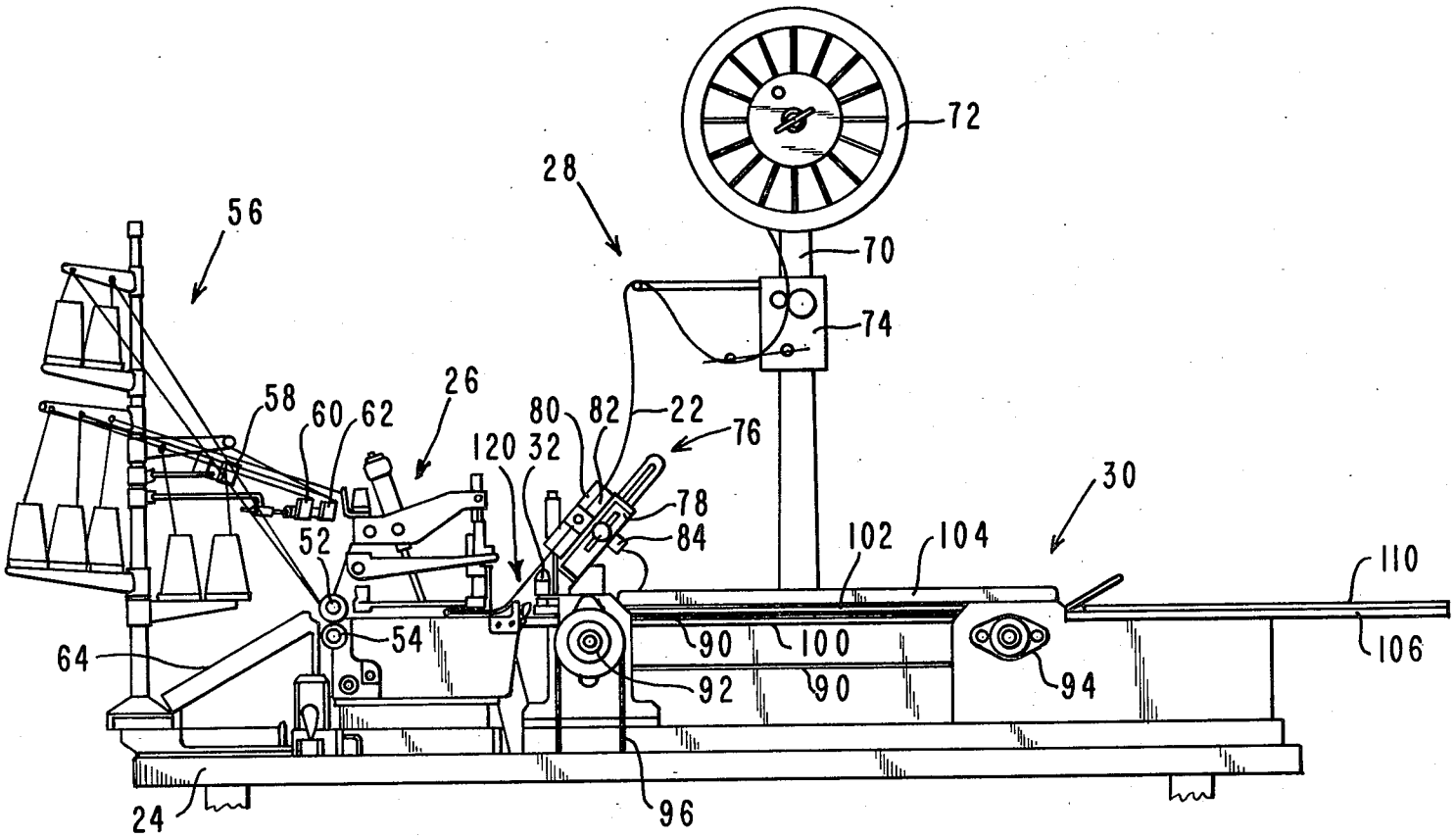
FIG. 1 is a side elevation view of an apparatus for sewing flypieces to continuous slide fastener chain in accordance with the invention.
Figure 2:
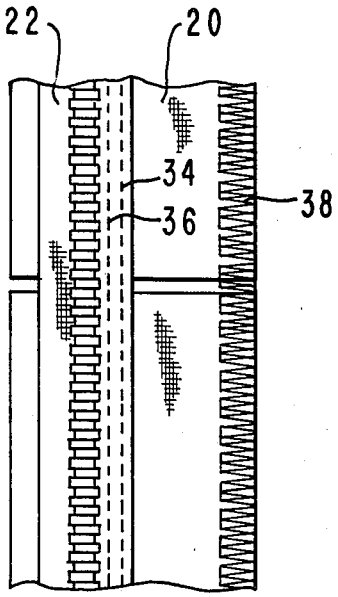
FIG. 2 is a plan view of a section of a continuous slide fastener chain with portions of two adjacent flypieces sewn thereto by the apparatus of FIG. 1.

As shown in FIG. 1, an apparatus for sewing flypieces 20, FIG. 2, to a continuous slide fastener chain 22 in accordance with the invention, generally includes a table top 24 on which are mounted a sewing machine indicated generally at 26, a mechanism indicated generally at 28 for feeding the slide fastener chain 22 to the sewing machine, and a flypiece conveyor and feeding arrangement indicated generally at 30 for feeding flypieces to the sewing machine. A photosensor 32 is mounted at the end of the flypiece conveyor and feeding arrangment 36 spaced in front of the sewing machine 26 for sensing the flypieces 20. Control circuitry, shown in FIGS. 7, 8, 9 and 10, includes the sensor 32 and is connected to the sewing machine 26 and the conveyor arrangement 30. Generally in operation of the apparatus, the flypieces 20 are sequentially positioned by an operator in the conveyor and feeding arrangement 30 which feeds the flypieces to the sewing machine 26. Sensing of a flypiece by the sensor 32 causes the sewing machine 26 to be operated, and sensing of the absence of a flypiece by the sensor 32 terminates operation of the sewing machine 26 until the next flypiece is sensed.

The sewing machine 26 is a conventional sewing machine which is capable of simultaneously forming a pair of straight lines of chain stitching 34 and 36 together with an overedge or serge stitching 38. Conventional dual chain stitch forming mechanism includes a pair of needles 40 and 42, FIGS. 4 and 5, while the conventional serge mechanism includes a needle 44. The sewing machine also includes a vacuum unit (not shown) to collect scrap from a conventional edge trimming facility (not shown) for trimming the edge of the flypiece being advanced into the serging station. A conventional feed dog (not shown) cooperates with a presser foot 46, FIG. 6, to move the slide fastener chain and flypieces through the sewing station in timed relationship with the sewing mechanisms. The presser foot 46 includes conventional directing grooves for guiding the slide fastener chain 22 through the sewing station. The sewing machine also includes a motor 48, FIG. 7, and a solenoid clutch 50, FIG. 7, for connecting and disconnecting the motor 48 from the drive of the sewing machine. Additionally, a conventional puller having pull wheels 52 and 54 is mounted on the sewing machine 26 and is used primarily for heavy material to maintain a constant top and bottom feed of the respective slide fastener chain 22 and flypieces 20 at the sewing operation. A thread spool holding arrangement indicated generally at 56 is mounted on the table 24 and includes various thread guides for directing threads to the sewing machine 26. Thread detectors 58, 60 and 62 are also mounted on the holder 56 and are placed on the three threads passing to the needles of the sewing machine 26. The detectors 58, 60 and 62 are a type which also detects breakage of corresponding looper threads by means of the failure of the needle thread to feed. A chute 64 is mounted on the exit side of the sewing machine 26 for directing the assembled slide fastener chain and flypieces over the edge of the table top 24.

The feeding and directing mechanism 28 for the slide fastener chain 20 includes a support 70 on which is rotatably mounted a reel 72 containing a supply of the slide fastener chain 22. A conventional chain feeder 74, controlled by a loop in the chain 22, is mounted on the support 70 for pulling the slide fastener chain from the reel 72 to prevent excess tension in the chain passing to the sewing machine 26. A splice and end of reel detector indicated generally at 76 is adjustably mounted on a bracket 78 supported on the end of the conveyor mechanism 30 adjacent the sewing machine 26. The detector 76 includes a pair of hinged members 80 and 82 with suitable channel means (not shown) formed therebetween for passing the slide fastener chain 22. A photosensor 84 is mounted on the detector 76 for detecting either a first condition corresponding to the presence of a non-spliced section of slide fastener chain at the sensor, or a second condition corresponding to the presence of a splice or the absence of a slide fastener chain in the detector. The bracket 78 includes slots for permitting the detector 76 to be mounted at a selected distance from the sewing machine 26 in accordance with the desired length of flypiece being sewn.

The conveyor and feed arrangement 30 for the flypieces 20 includes a belt conveyor 90 passing over a pulley and driven-roller arrangement 92 mounted directly in front and adjacent the sewing machine 22 and passing at its other end over a roller and bearing assembly 94 mounted on the table 24. The pulley and driven roller arrangement 92 is drivingly connected by a belt 96 to a motor 98, FIG. 7. A backing plate 100 and a hold down plate 102 mounted on an upper cover member 104 extend on the respective lower and upper sides of the upper course of the conveyor belt 90 which runs in a direction for feeding the flypieces 20 to the sewing machine 26. A horizontal plate 106 is mounted on the table top 24 in front of the front end of the conveyor 90 in alignment with the upper surface thereof. A portion 108 of the plate 106 extends to one side for receiving and supporting a plurality or supply of the flypieces 20. A guide bar 110 is mounted on the opposite side of the plate 106 in alignment with one edge of a desired path for feeding the flypieces 20 to the conveyor 90 and sewing machine 26.

The sewing machine 26 is set to feed the flypieces 20 and slide fastener chain 22 through the sewing station at a first linear feed rate during sewing. The conveyor mechanism 30 is set to feed the flypieces 20 toward the sewing machine 26 at a second linear feed rate which is substantially slower than the linear feed rate of the sewing machine. Preferably the linear feed rate of the conveyor is in the range from five to ten percent slower than the linear feed rate of the sewing machine.

Figure 6:
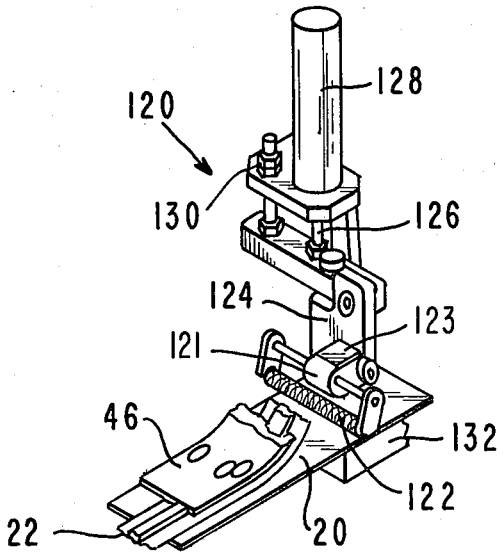
FIG. 6 is a perspective view of a tension roller mechanism for tensioning flypieces being sewn in the apparatus of FIG. 1.

A flypiece tensioning device indicated generally at 120 in FIGS. 1 and 6 includes a knurled roller 122 rotatably mounted on a pivoted member 121, biased downward by a spring 123, on a carriage 124 which is secured to the end of a piston rod 126 extending from an air cylinder 128 mounted by a suitable support on the table 24. An adjustable stop 130 is mounted on the bracket 124 for engaging the support for the air cylinder 128 to control the spring pressure on the roller 122. A stationary member 132 is mounted underneath the roller 122 for frictionally and slidingly engaging the flypieces 20.

Figure 3:
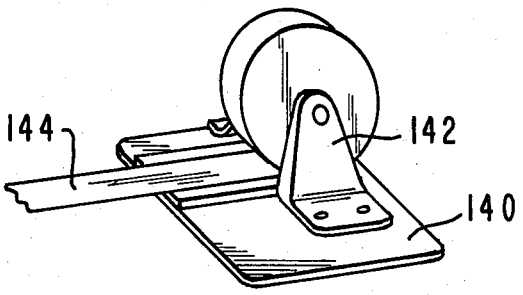
FIG. 3 is a perspective view of a continuous strip feeder which can be substituted in the apparatus of FIG. 1.
Figure 4:
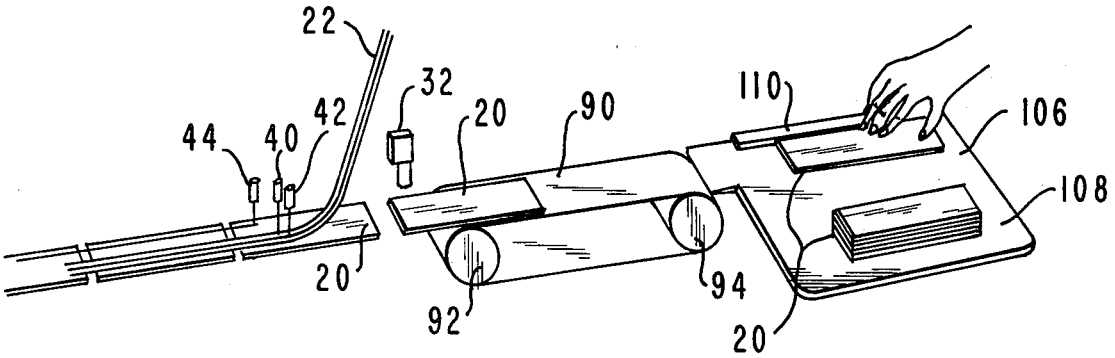
FIG. 4 is a perspective diagram illustrating operation of the feeding of flypieces in the apparatus of FIG. 1.
Figure 5:
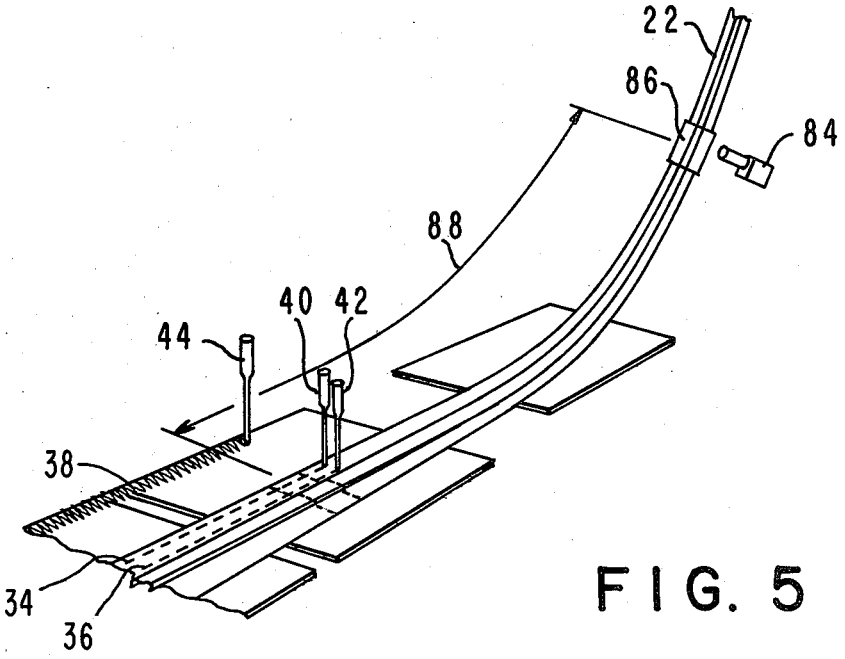
FIG. 5 is a perspective diagram illustrating the preventation of sewing flypieces to spliced sections of slide fastener chain.

In FIG. 3, there is illustrated a plate 10 on which is mounted a roll dispenser 142 which may be substituted for the plate 106 of FIGS. 1 and 4. The roll dispenser 142 will be employed where a continuous strip 144 of flypiece material is to be sewn to the slide fastener chain 122 instead of individual flypieces 20.

Figure 7:
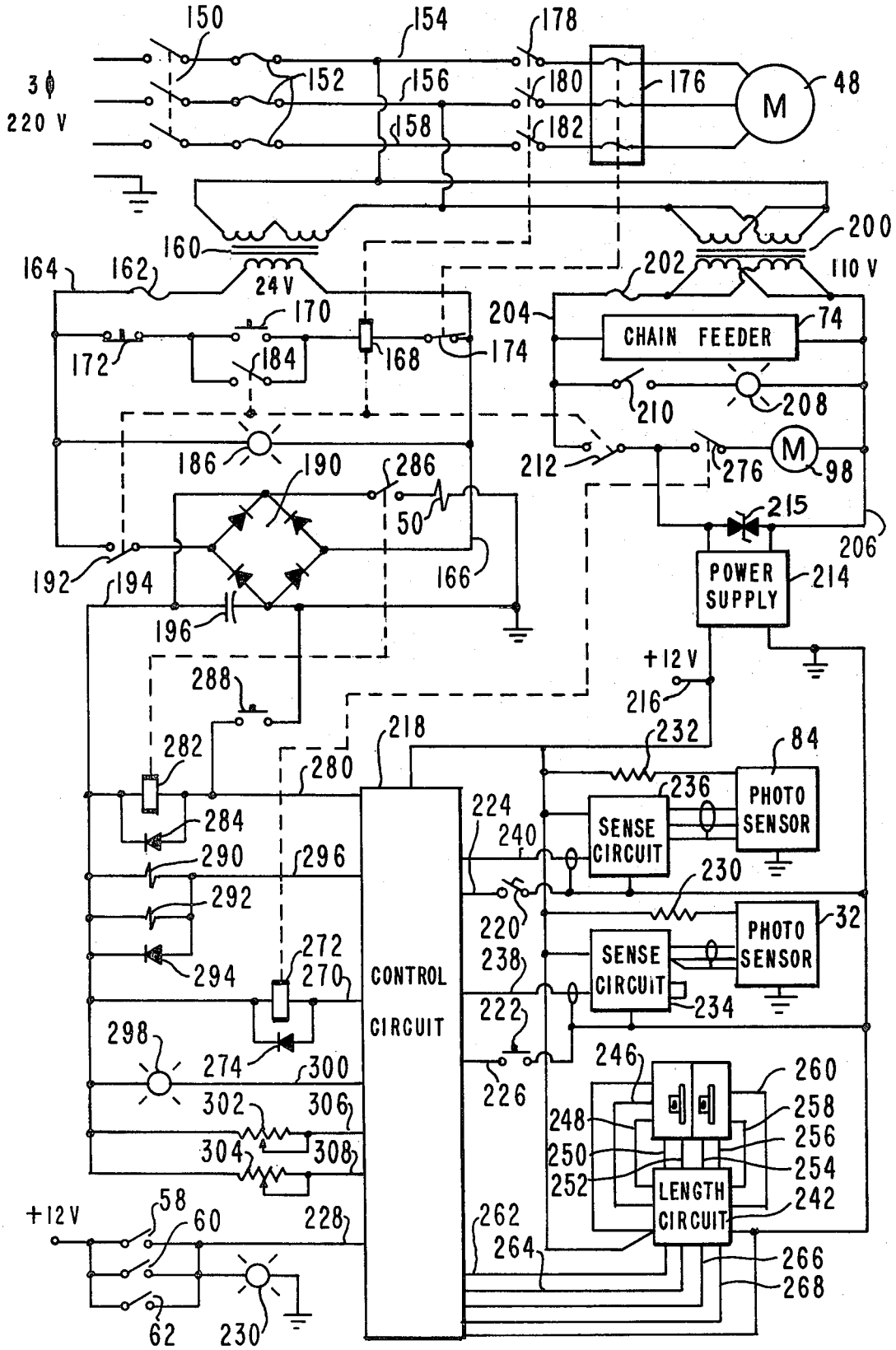
FIG. 7 is a diagram of an overall circuit controlling the operation of the apparatus of FIG. 1.

In the overall circuit for controlling the operation of the apparatus for sewing flypieces to slide fastener chain as shown in FIG. 7, input lines adapted to be connected to a three-phase power source are connected by respective contacts of a power switch 150 and fuses 152 to lines 154, 156 and 158. A stepdown transformer 160 has its primary winding connected across lines 154 and 156 and its secondary winding connected in series with a fuse 162 across lines 164 and 166. The winding of a start relay 168 is connected in series with normally open contacts of a start push button switch 170, normally closed contacts of a stop push button switch 172 and normally closed contacts 174 of an overcurrent motor protector 176. Normally open contacts 178, 180 and 182 of the start relay 168 are connected between the respective lines 154, 156 and 158 through the protector 176 to respective inputs of the sewing machine motor 48. Normally open holding contacts 184 of the relay 168 are connected across the start switch 170 to maintain the start relay 168 energized after the start switch 170 has been operated. A power-on indicating lamp 186 is connected across the lines 164 and 166.

A full wave rectifier 190 has one input connected to the line 166 and has its other input connected by normally open contacts 192 of the start relay 168 to the other power line 164. The negative output of the rectifier 190 is connected to the common or ground line while the positive output is connected to line 194. A filter capacitance 196 is connected across the line 194 and ground. The line 194 is the direct current power line from which several relays and solenoids and other components receive their power in the circuit.

A second transformer 200 has its primary winding connected across the lines 154 and 156 and has its secondary winding connected in series with a fuse 202 across lines 204 and 206. The chain feeder mechansim 74 as well as a work area lamp 208 and its associated serially connected switch 210 are connected directly across the power line 204 and 206. Normally open contacts 212 of the start relay 168 connect the line 204 to one input of a conventional DC power supply 214 which has its other input connected to the line 206. A semiconductor voltage protector 215 is connected across the inputs of the power supply 214. The negative output of the power supply 214 is connected to the ground or common line and the positive output of the power supply is connected to line 216. The line 216 supplies D.C. power to a control circuit 218 as well as to other circuits and components being operated by low DC power voltage.

A foot switch 220 of the maintained type and a normally open push button "reset" switch 222 are connected between ground and respective lines 224 and 226. The thread break detectors 58, 60 and 62 have one sides connected to the positive supply line 216 and have their opposite sides connected by line 228 to the control circuit 218. A lamp 230 is connected between the line 228 joined to a common side of the detectors 58, 60 and 62 and ground for indicating a thread breakage. The power line 216 is connected by respective resistors 230 and 232 to the photosensors 32 and 84 which are connected by suitable lines, along with the power line 216 to respective sensing circuits 234 and 236 which in turn are connected by respective output lines 238 and 240 to the control circuit 218. The power line 216 is also connected to a length circuit 242 as well as a two digit BCD thumbwheel switch 244 which has its output on lines 246, 248, 250, 252, 254, 256, 258 and 260 connected to the length circuit 242. Lines 263, 264, 266 and 268 connect the length circuit 242 to the control circuit 218.

Figure 8:
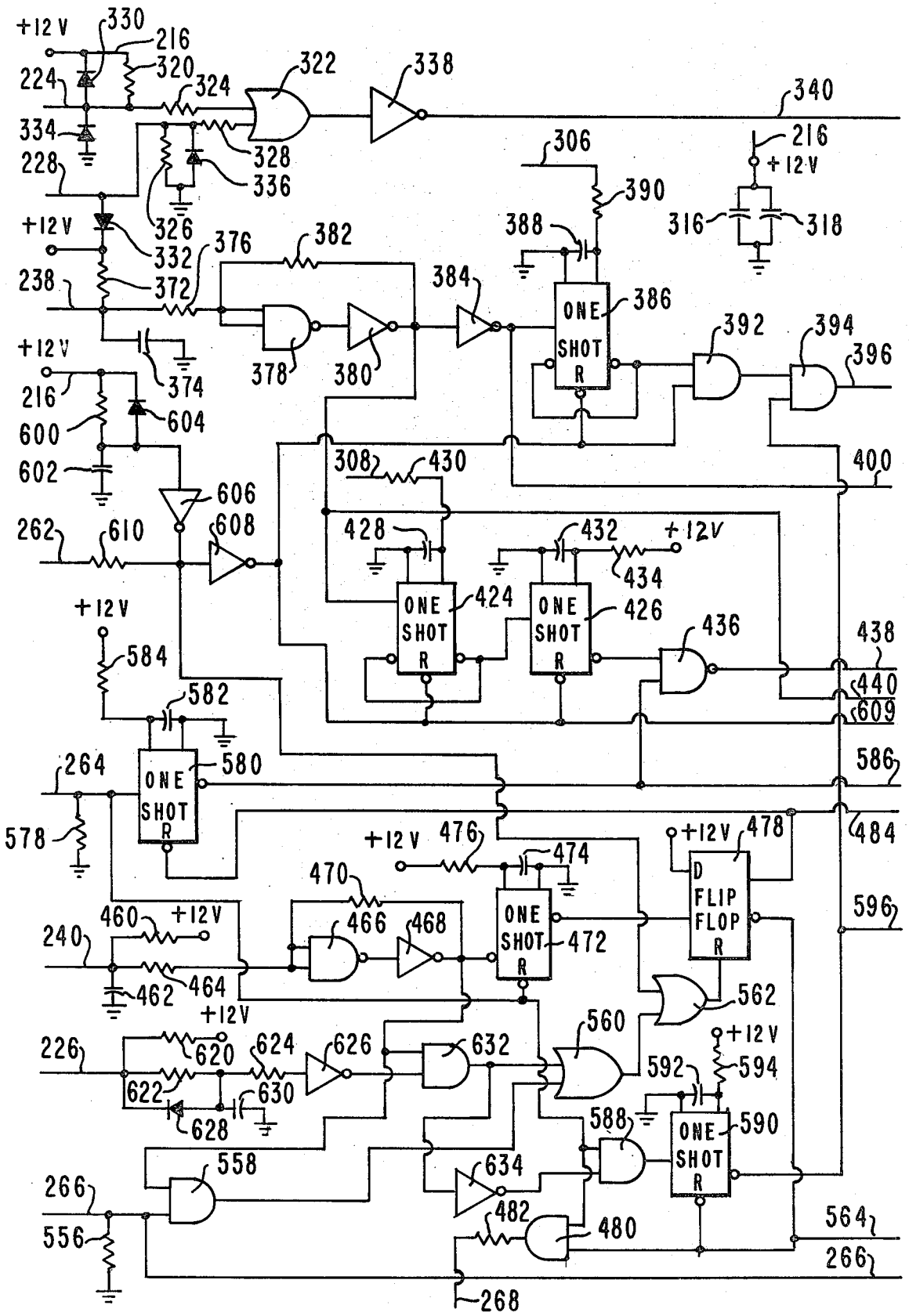
FIG. 8 is a detailed electrical diagram of one portion of a control circuit of the circuitry of FIG. 7.
Figure 9:
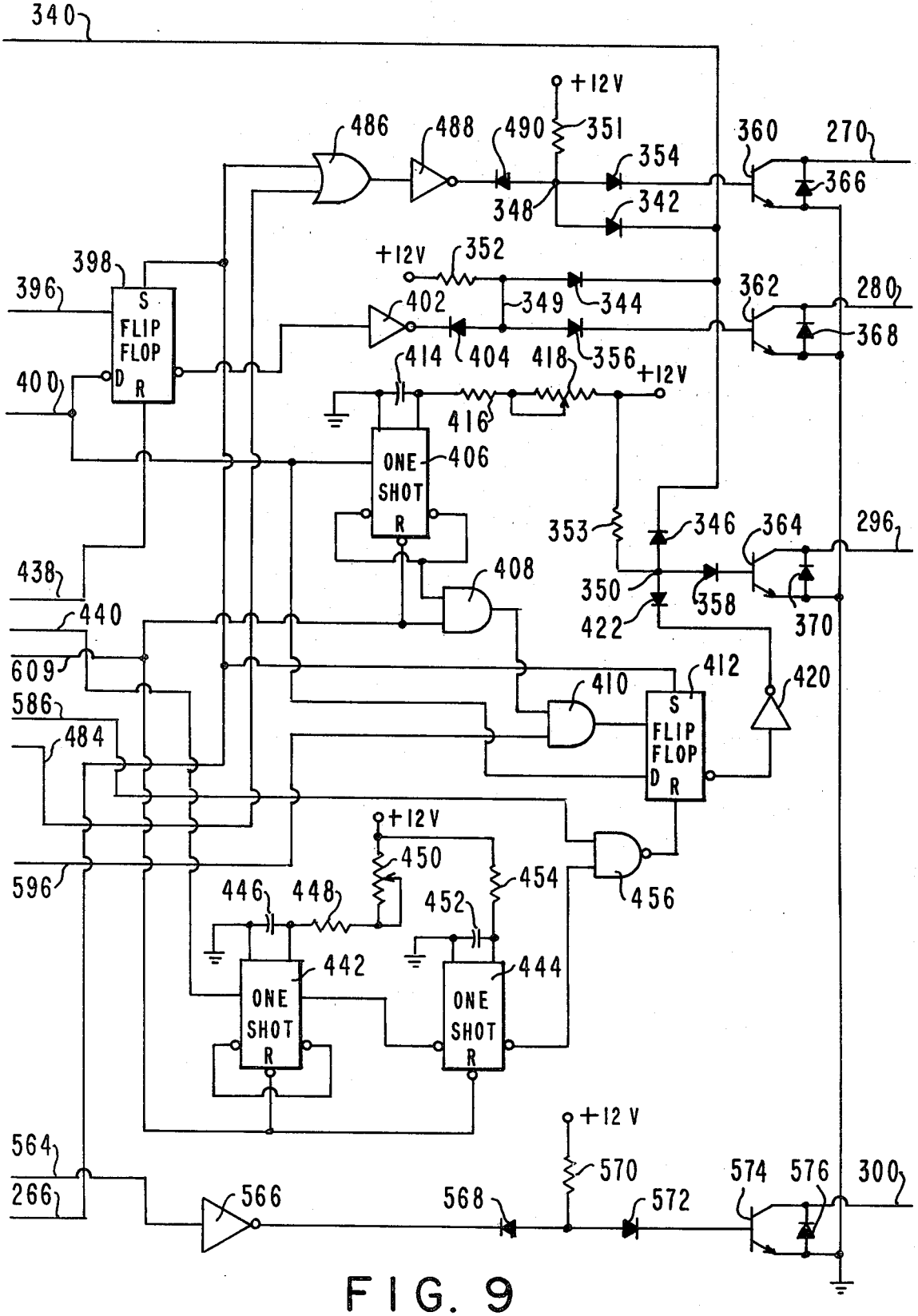
FIG. 9 is a detailed electrical diagram of a second portion of a control circuit of FIG. 7; the complete control circuit may be viewed by positioning FIGS. 8 and 9 side by side with FIG. 8 on the left and FIG. 9 on the right.

The photosensors 32 and 84 are commercial devices each of which contains a light-emitting diode (not shown) and a phototransistor (not shown) arranged so that the phototransistor detects light reflected back to the device from a beam of light emitted by the light emitting diode. The sensing circuits 234 and 236 also are commercially available circuits which energize the light emitting diodes of the sensors 32 and 84 with current of a selected frequency and detect outputs of the sensor photodiodes having this selected frequency and a selected magnitude. In the circuit of FIGS. 7–9, the sensing circuit 234 is set to connect line 238 to ground when a flypiece is under the photosensor 32 and to produce an open circuit in line 238 when there is an absence any flypiece under the photosensor 32; and the sensing circuit 236 is set to produce an open circuit in line 240 when a non-spliced section of slide fastener chain is in front of the sensor 84 and to connect line 240 to ground when either there is a splice in front of the sensor 84 or there is an absence of any slide fastener chain in front of the sensor 84.

One output of the control circuit 218 on line 270 is connected to one side of a relay winding 272 which has its other side connected to the power line 194, a protective diode 274 being connected across the relay winding 272. Normally open contacts 276 of the relay 272 are connected on one side to the junction between the start relay contacts 212 and the power supply input 214 and are connected on the other side to one input of the conveyor motor 98 which has its other input connected to line 206. Another output of the control circuit 218 on line 280 is connected to one side of a relay winding 282 which has its other side connected to the power line 194, a protective diode 284 being connected across the relay winding 282. Normally open contacts 286 of the relay 282 are connected between the power line 194 and one side of the sewing machine clutch solenoid 50 which has its other side connected to ground. A normally open push button switch 288 is connected between the line 280 and ground for enabling manual operation of the relay 282. A parallel arrangement of a batch counter 290, solenoid valve 292 which operates the cylinder 128 (FIG. 6), and protective diode 294 are connected between output line 296 of control circuit 218 and the power line 194. An end of reel indicator lamp 298 is connected between the power line 194 and an output line 300 of the control circuit 218. Variable delay resistances or potentiometers 302 and 304 are connected between the power line 194 and respective lines 306 and 308 to inputs of the control circuit 218. The resistance 302 is set in accordance with a desired delay between sensing of the leading edge of a flypiece and the starting of the sewing machine 26. The resistance 304 is set in accordance with a desired delay between the sensing of the trailing edge of a flypiece and the termination of operation of the sewing machine. The delays of the starting and termination of the operation of the sewing machine are set relative to each other so that a predetermined spacing greater than no spacing is produced between adjacent flypieces sewn to the slide fastener chain. Preferably this predetermined spacing is relatively small to avoid excessive waste of slide fastener chain.

In the control circuit 218, shown in detail in FIGS. 8 and 9, line 224 from the foot switch 220 is biased positive by a resistance 320 connected between the line 224 and the voltage supply line 216 filtered by capacitances 316 and 318, and is connected to one input of an OR gate 322 by a resistance 324. The line 228 from the thread detectors 58, 60 and 62 is biased to zero by a resistance 326 connected to ground and is connected to the other input of the OR gate 322 by a resistance 328. Suitable diodes 330 and 332 are connected between the positive voltage and the respective lines 224 and 228, and suitable diodes 334 and 336 are connected between ground and the respective lines 224 and 228 for protecting circuit components against excessive voltages on lines 224 and 228. The output of the OR gate 322 is connected by an inverter 338 to a line 340 which is connected to the cathodes of respective diodes 342, 344 and 346 which have their anodes connected to respective junctions 348, 349 and 350 biased by respective resistances 351, 352 and 353 connected to the positive voltage line. Diodes 354, 356 and 358 have their anodes connected to the respective junctions 348, 349 and 350 and have their cathodes connected to bases of respective NPN transistors 360, 362 and 364 which have their emitters connected to ground and their collectors respectively connected to line 270 which operates the conveyor motor relay 272, line 280 which operates the sewing machine clutch control relay 282, and line 296 which operates the flypiece tension control solenoid valve 292 and counter 290. Protective diodes 366, 368 and 370 are connected across the collector and emitters of the transistors 360, 362 and 364 for preventing damage to the transistors.

Line 238 connected to the flypiece sensing circuit 234 of FIG. 7 is biased positive by resistance 372 connected to the positive voltage line, is filtered by capacitance 374 connected to ground, and is connected by resistance 376 to both inputs of a NAND gate 378. The output of the NAND gate 378 is connected to an inverter 380 which has its output coupled by resistance 382 back to the inputs of the NAND gate 378 to form a trigger circuit. The output of the inverter 380 is coupled by an inverter 384 to the positive triggered input of a one-shot 386 which has a timing capacitance 388 coupled thereto and has a timing resistance 390 connected to the variable start delay line 306, see also FIG. 7. The inverted output of the one-shot 386 is connected by serially connected AND gates 392 and 394 to line 396 which is connected to the positive triggering input of a D-type flip-flop 398 having its data input connected to line 400 from the output of the inverter 384. The inverted output of the flip-flop 398 is coupled by an inverter 402 to the cathode of a diode 404 which has its anode connected to the junction 398 for operating the sewing machine clutch transistor 362. Additionally, the line 400 is connected to a positive triggering input of a one shot 406 which has its inverted output coupled by series connected AND gates 408 and 410 to the positive triggering input of a D-type flip-flop 412 which has its data input connected to the line 400. The one shot 406 has a timing capacitance 414 and a resistance 416 connected in series with a selectively variable resistance or potentiometer 418 to the positive voltage source for selecting a predetermined length of output from the one-shot 406. The inverted output of the flip-flop 412 is connected by an inverter 420 to the cathode of a diode 422 which has its anode connected to the junction 350 for operating the counting and flypiece tension valve transistor 364. The length of output from one-shot 406 is set to produce a delay in operation of the flip-flop 412 so that the leading edge of a flypiece is passed into and gripped by the sewing station prior to operation of the tensioning device 120.

The output of the inverter 380 is connected to a positively triggered input of a one-shot 424 which has its inverted output connected to a positive triggered input of a one shot 426. The one shot 424 includes a timing capacitance 428 coupled thereto and a resistance 430 connected to the stop delay timing line 308. The one-shot 426 includes a timing capacitance 432 and a timing resistance 434 connected to the positive voltage and selected to produce a suitable resetting pulse for the flip-flop 398. The inverted output of the one shot 426 is coupled by an AND gate 436 to a line 438 which is connected to the reset input of sewing flip-flop 398. The output of inverter 380 is also connected by line 440 to a positive triggered input of a one-shot 442 which has its normal output connected to the negatively triggered input of a one-shot 444. The one-shot 443 includes a timing capacitance 446 and a resistance 448 connected to one end of a variable timing resistance 450 which has its other end connected to the positive voltage. The resistances 448 and 450 are selected to produce a desirable delay in turnoff of the flypiece tension mechanism corresponding to the time required for the trailing end of a flypiece to travel from the sensor 32 to just past the tensioning mechanism 120. The one shot 444 includes a timing capacitance 452 and a timing resistance 454 selected to give a suitable resetting pulse for the flip-flop 412. The inverted output of the one shot 444 is coupled by a NAND gate 456 to the reset input of the flip-flop 412.

The splice or end of reel line 240 is biased by a resistance 460 connected to positive voltage, is filtered by a capacitance 462 connected to ground, and is connected by a resistance 464 to both inputs of a NAND gate 466. The output of the NAND gate 466 is connected to an inverter 468 which has its output coupled back to the inputs of the NAND gate 466 by a resistance 470 to form a trigger circuit. The output of the inverter 468 is connected to the negative triggered input of a one shot 472 which includes a timing capacitance 474 and a timing resistance 476 which is connected to the positive voltage supply line. The inverted output of the one shot 472 is connected to the positive triggered input of a D-type flip-flop with its data input high. The inverted output of the flip-flop 478 is connected to one input of an AND gate 480 which has its output connected by a resistance 482 to the feed length start line 268. The noraml output of the flip-flop 478 is connected by a line 484 to an input of an OR gate 486 which has its output coupled by an inverter 488 to the cathode of a diode 490 which has its anode connected to the junction 348 for controlling operation of the conveyor motor transistor 360.

Figure 10:
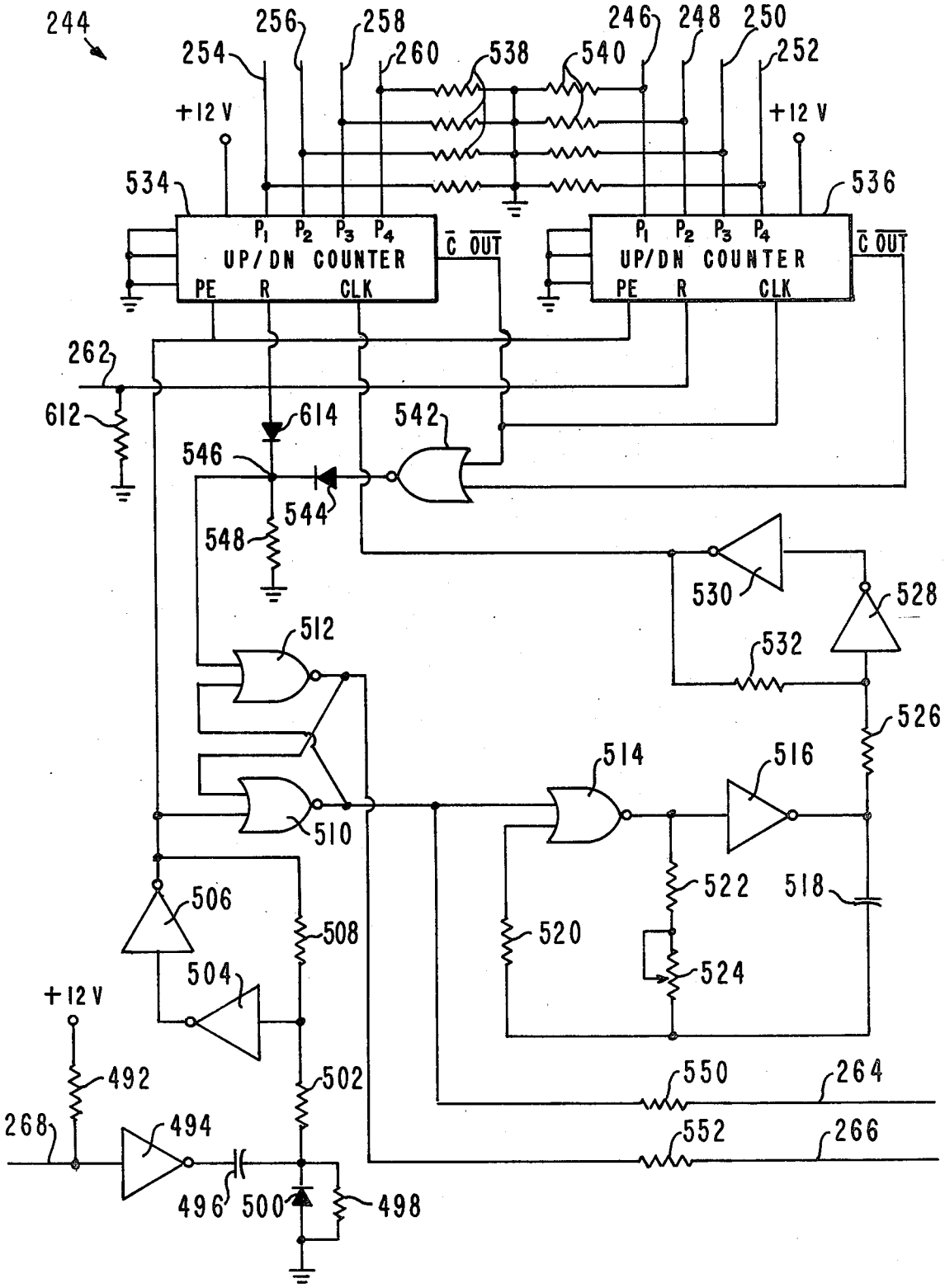
FIG. 10 is a detailed electrical diagram of a length circuit of the overall circuit of FIG. 7.

In the length circuit 244, as shown in FIG. 10, the feed length start line 268 is connected by a bias resistance 492 to the positive voltage supply line and is connected to the input of an inverter 494 which has its output connected to a differentiating circuit formed by a capacitance 496 connected between the inverter 494 and one side of a parallel arrangement of a resistance 498 and a diode 500 which have their other side connected to ground, the cathode of the diode 500 being connected to the capacitance 496. The junction between the capacitance 496 and the resistance 498 is connected by a resistance 502 to the input of an inverter 504 which has its output connected to another inverter 506 which has its output coupled back to the input of the first inverter 504 by a resistance 508 to form a trigger circuit. The output of this trigger circuit from inverter 506 is coupled to one input of NOR gate 510 which has its output connected to an input of a NOR gate 512 and which has its second input connected to the output of the NOR gate 512 to form a flip-flop circuit. The output of the NOR gate 510 is connected to one input of a NOR gate 514 which has its output connected to the input of an inverter amplifier 516. The output of the inverter amplifier 516 is connected by serially joined capacitance 518 and 520 back to the second input of the NOR gate 514, and the junction of the resistance 520 and capacitance 518 is joined to the output of NOR gate 514 by a serially connected resistance 522 and potentiometer 524. The NOR gate 514, inverter 516 and associated capacitance 518 and resistances 520, 522 and 524 form an oscillator circuit. The output of this oscillator from the inverter 516 is connected by a resistance 526 to the input of the inverter 528 which has its output connected to an input of an inverter 530 having its output coupled back to the input of the first inverter 520 by a resistance 532 to form a trigger circuit. The output of this trigger circuit from the inverter 530 is connected to the clock input of a counter 534 which has its carry output connected to the clock input of a second presettable up/down counter 536. The counters 534 and 536 are set to operate in their count down mode. The least significant digit lines 254, 256, 258 and 260 from the thumbwheel switch 244 of FIG. 7 are connected by respective bias resistances 538 to ground and are connected to the preset inputs of the counter 534 while the most significant digit lines 246, 248, 250 and 252 from the thumb wheel switch are connected by respective bias resistances 540 to ground and to the preset inputs of the counter 536. The preset enable inputs of the counters 534 and 536 are connected to the output of the inverter 506. The carry outputs of the counters 534 and 536 are connected to respective inputs of a NOR gate 542 which has its output connected to the anode of a diode 544 having its cathode connected to a junction 546 which in turn is biased by a resistance 548 to ground. The junction 546 is connected to the second input of the NOR gate 512 for resetting the flip-flop. Outputs of the flip-flop on the respective outputs of the NOR gates 510 and 512 are connected by respective resistances 550 and 552 to the inverted feed length line 264 and to the normal feed length line 266, respectively. The thumb wheel switch 244 of FIG. 7 is set at a desired length, i.e. the length of one flypiece plus the length of a splice, to avoid the sewing of a flypiece on a spliced section of slide fastener chain.

The feed length line 266 in FIGS. 8 and 9 is connected by a bias resistance 556 to ground and is connected to a second input of the OR gate 486 and to set inputs of flip-flops 398 and 412 for turning the conveyor motor off and running the sewing machine during countdown of the thumbwheel setting. The output of the inverter 468 is connected to one input of an AND gate 558 which has its other input coupled to the normal feed length line 266. The output of the AND gate 558 is coupled by a pair of serially connected OR gates 560 and 562 to the reset input of the flip-flop 478. Line 564 connects the inverted output of the flip-flop 478 to an inverter 566 which has its output coupled to the cathode of a diode 568 having an anode connected by bias resistor 570 to positive voltage. A diode 572 has its anode connected to the junction of the diode 568 and resistance 570 and has its cathode connected to the base of an NPN transistor 574 which has its emitter connected to ground and its collector connected to the end of reel indicating lamp line 300. A protective diode 576 is coupled across the emitter and collector of the transistor 574. The inverted feed length signal line 264 is connected by bias resistance 578 to ground and is connected to the positive input of a one shot 580 which has its reset input connected to line 484 from the normal output of end-of-reel flip-flop 478 and which includes a timing capacitance 582 with a timing resistance 584 connected to the positive voltage supply line. The inverted output of the one shot 580 is connected by line 586 to second inputs of AND gates 436 and 456 which drive the reset inputs of the sewing flip-flop 398 and tension flip-flop 412. The inverted feed length line 264 is also connected to the reset input of the one shop 472 and to one input of an AND gate 588 which is connected to the positive triggering input of a one-shot 590. A timing capacitance 592 and a timing resistance 594 connected to the positive source line are included in the one-shot 590. The inverted output of the end of reel flip-flop 478 is connected to the low-activated reset input of the one-shot 590. The inverted output of the one-shot 590 is coupled by line 596 to second inputs of AND gates 394 and 410.

In an initial power up reset circuit, the power input line 216 is connected to one end of a resistance 600 which has its other end connected to one side of a capacitance 602 having its other side grounded. A diode 604 has its anode connected to the junction between the resistance 600 and the capacitance 602 and has its cathode connected to the power line 216. The junction between the resistance 600 and the capacitance 602 is connected to the input of an inverter 606 which has its output coupled to a second input of the OR gate 562 and to the input of a second inverter 608 which has its output on line 609 coupled to the reset inputs of one shots 386, 406, 424, 426, 442 and 444 as well as to second inputs of AND gates 392 and 408. The output of the inverter 606 is connected by a resistance 610 to a reset line 262 which, as shown in FIG. 10, is connected by a bias resistance 612 to ground and is connected to reset inputs of the counters 534 and 536 and to the anode of a diode 614 which has its cathode connected to the reset junction 546.

The defect restart line 226 is connected by a bias resistance 620 to the positive voltage line and is connected by a pair of serially joined resistances 622 and 624 to the input of an inverter 626. A protective diode 628 is coupled across the resistance 622 and a filter capacitance 630 is coupled between ground and the junction between resistances 622 and 624. The output of the inverter 626 is connected to one input of an AND gate 632 which has its other input connected to the output of the inverter 468. The output of the AND gate 632 is connected to a second input of the OR gate 560 and is connected by an inverter 634 to a second input of the AND gate 588.

In operation of the apparatus for sewing the flypieces 20 to the slide fastener chain 22 simultaneously with serging of the edge of the flypieces 20, the power switches 150, FIG. 7, are initially closed applying three phase power to the lines 154, 156 and 158 to energize transformers 160 and 200 and the power lines 164, 166, 204 and 206 as well as the chain feeder 74. The start push button switch 170 is momentarily depressed, energizing the relay 168 to close contacts 178, 180 and 182, operating the motor 48. Also contacts 184 of the relay 168 are closed, bypassing the start switch 170 to hold the relay 168 energized until the stop switch 172 is depressed or the contacts 174 of the motor protective unit 176 open. Contacts 192 and 212 of the relay 168 also are closed, energizing the full wave rectifier 190 and the power supply 214, respectively, to apply respective direct current voltages to the power lines 194 and 216.

When power is initially applied to the line 216 in the control circuit 218 of FIGS. 8 and 9, power is applied to the components of the circuit but the input of inverter 606 remains low for a short period of time determined by the charging time of the capacitance 602 through the resistance 600. The output of the inverter 606 thus momentarily applies a positive voltage to the reset input of the flip-flop 478, and the inverter 608 momentarily applies low logic voltages to the reset inputs of one shots 386, 406, 424, 426, 442 and 444, as well as to clock inputs of the flip-flops 398 and 412. Additionally, the master reset signal on line 262 is applied, in FIG. 10, to the counters 534 and 536 to reset these counters to zero count and is applied to the flip-flop formed by gates 510 and 512 to set the normal feed length line 266 low and the inverted feed length line 264 high.

The foot switch 200, FIG. 7, is initially open which permits line 224, FIG. 8, to be biased high and apply a high to OR gate 322 which causes inverter 338 to produce a low on line 340. With line 340 low, the junctions 348, 349 and 350 are held low by current conduction through diodes 342, 344 and 346 to hold the transistors 360, 362 and 364 non-conductive. When the switch 220 is closed to start the apparatus, the line 340, by means of the OR gate 322 and inverter 338 is rendered high, terminating conduction through diodes 342, 344 and 346. Since line 484 from the flip-flop 478 and the normal feed length line 266 are low, the OR gate 486 causes inverter 488 to apply a high voltage to diode 490 to render it non-conductive. This permits junction 348 to be biased high, causing the base of transistor 360 to be biased high by current conduction through diode 354 to render transistor 360 conductive. With transistor 360 conductive, current through line 270 operates the relay 272, FIG. 7, closing contacts 276 to operate the conveyor motor 98. With the conveyor motor running, the conveyor 90 is operating and flypieces 20 are sequentially positioned, as shown in FIG. 4, by the operator against the bar 110 and pushed forward onto the conveyor 90 where the conveyor advances the flypieces toward the sewing machine 26, FIG. 1.

The flypiece sensing line 238 is high when there is an absence of any flypiece at the sensor 32 to produce a low output on line 400 from inverter 484 causing the flip-flops 398 and 412 to be placed in their reset condition when a pulse is applied on line 396 from the power up reset circuitry. The inverted outputs of the flip-flops 398 and 412 are high in this condition driving the outputs of inverters 402 and 420 low to hold the junctions 349 and 350 low by current conduction through diodes 404 and 422. The low voltages on junctions 349 and 350 hold the transistors 368 and 370 nonconductive, preventing current in lines 280 and 296 controlling the sewing machine clutch relay 282, the tension solenoid valve 290 and the counter 292. When the leading edge of a flypiece 20 travelling down the conveyor 90 reaches the sensor 32, the line 238 goes low, causing the output of inverter 384 to go high which triggers the one shot 386. After a delay determined in part by resistance 302, the leading edge of the flypiece 20 is pushed by the conveyor 90 into the sewing station and the trailing edge of the output pulse from one shot 326 clocks the flip-flop 398 to the condition determined by line 400 from the output of inverter 384, that is, the flip-flop is clocked to the set condition where the inverted output of the flip-flop 398 goes low. This results in the output of inverter 402 going high causing junction 349 to be driven high which renders the transistor 362 conductive to operate the relay 282, FIG. 7, and energize the sewing machine clutch 50. Thus, the sewing machine 26 is operated to sew the flypiece 20 by stitch lines 34 and 36 to the slide fastener chain 22 and to form overedge stitching 38.

Also, the output of inverter 384 on line 400 operates the one shot 406 which, after a delay determined in part by the resistance 418 selected to wait until a leading edge of the flypiece is gripped and being sewn by the sewing machine, operates the flip-flop 412. Operation of the flip-flop 412 drives the output of inverter 20 high which results in the transistor 364 becoming conductive to operate the tension air valve solenoid 290 as well as the counter solenoid 292, FIG. 7. Operation of the solenoid valve 290 results in the air cylinder 128 of FIG. 6 being operated to lower the roller 122 to force the flypiece 20 against plate 132. This creates a frictional drag on the flypiece 20 which maintains the flypiece 20 in a straight line during movement through the serging and chain stitch sewing mechanisms of the sewing machine 26.

When the trailing end of the flypiece 20 passes beneath the sensor 32, the flypiece sensing line 238 goes high which also renders the output of inverter 380 on line 400 high, operating the one shots 424 and 442. After a delay determined in part by the variable resistance 304, FIG. 7, and corresponding to the trailing end of the flypiece reaching a predetermined position at the sewing station, the trailing edge of the output from one-shot 424 operates one-shot 426 which resets flip-flop 398 to stop the sewing machine. Similarly, the one-shot 442 operates one-shot 444 to reset flip-flop 412 and raise the tension mechanism 120 after a delay, determined in part by the resistance 450 corresponding to the time required for the trailing end of the flypiece being sewn to just pass the tensioning mechanism.

The flypiece 20 being sewn is advanced linearly through the sewing station at a speed which is substantially greater than the linear advancement speed of the next flypiece on the conveyor 90. This results in the trailing end of a flypiece being sewn being pulled away from the leading edge of the next flypiece being advanced by the conveyor 90 to produce a spacing between flypieces equal to or greater than a desired uniform spacing between flypieces sewn to the slide fastener chain. The delay between stopping and the starting of the sewing machine by sensing the trailing end of the leading flypiece and the leading end of the trailing flypiece produce uniform spaces between adjacent flypieces sewn to the slide fastener chain. The sensor 32 is able to sense the trailing edge of the leading flypiece and the leading edge of the next flypiece in every instance to produce this uniform spacing between flypieces. If the flypieces were fed by the conveyor at the same speed as the advancement speed of the sewing machine, such uniform spacing would not be produced when flypieces are fed in abutting relationship, rather no spacing would be produced. A small spacing is necessary for further processing of the flypieces.

The apparatus prevents the sewing of flypieces 20 over splices on the slide fastener chain 22 and automatically stops when the chain 22 from the reel 72 runs out. When a splice is present in front of the photosensor 84 or when there is an absence of any slide fastener chain, the sense circuit 236 produces a low logic signal on line 240. Referring to FIG. 8, the low on line 240 is applied by NAND gate 466 and inverter 468 to the one shot 472 which after a preset delay operates the flip-flop 478. The inverted output of flip-flop 478 goes low which produces a low output from AND gate 480 on the start feed length line 268. In FIG. 10, the low output on line 268 is inverted by inverter 494 to produce an output which is differentiated by the capacitance 496 and resistance 498. The pulse output of the differentiater is applied by inverters 504 and 506 to the flip-flop formed by NOR gates 510 and 512, causing the inverted feed length signal line 264 to go low and the normal feed length line 266 to go high. The pulse from the inverter 506 is also applied to the preset enabling inputs of the counters 534 and 536 to set the counters to the count selected by the thumb wheel switches 244, FIG. 7. The output of NOR gate 510 going low enables the oscillator formed by NOR gate 514, inverter 516, capacitance 518 and resistances 520, 522 and 524. The output of this oscillator is applied by inverters 528 and 530 to the clock input of the counter 534 to count down the count loaded into the counters 534 and 536. When the count in the counters 534 and 536 reaches zero, the C outputs of both of the counters go low causing the NOR gate 542 to produce a high output which is applied by the diode 544 to the NOR gate 512 to switch the flip-flop and render the inverted feed line 264 back to its high logic voltage and to render the feed length line 266 back to its normal low logic level. The high logic level on the feed length line 266, in FIGS. 8 and 9, holds the flip-flops 398 and 412 in their set condition to maintain the sewing machine in operation and to maintain tension from mechanism 120 on the flypiece being sewn. Also the line 266 operates OR gate 486 to produce a low output on inverter 488 which renders the junction 348 low and renders transistor 360 non-conductive to terminate operation of the conveyor 90 during the countdown of the count of the thumb wheel setting by the length circuit 242. The setting of the thumb wheel switches 244 of FIG. 7 is selected to produce a distance of travel 88, FIG. 5, of the splice 86 so that the splice 86 will be advanced past the predetermined point where sewing of the leading edge of the next flypiece will begin.

If a splice is detected by the sensor 84, the line 240 will return to its high condition after the splice 86 passes the sensor 84. This logic high voltage is applied by NAND gate 466, inverter 468, AND gate 632, OR gate 560 and OR gate 562 to the reset input of flip-flop 478. The return of the feed length line 266 to its low logic level at the end of the countdown by the length circuit results in the high logic level being removed from the set inputs of the flip-flops 398 and 413 and from the input of the NOR gate 486. In the case of a splice, the second output of NOR gate 486 from the output of flip-flop 478 is low since the flip-flop will have been reset, and the output of OR gate 486 goes low, rendering the junction 348 high to once again begin conduction through the transistor 360 to operate the conveyor. When the flip-flop 478 is reset indicating only a splice, the normal output of the flip-flop disables one-shot 580, but the one-shot 590 is enabled. The line 264 going high at the end of the countdown period through AND gate 588 triggers one shot 590 which applies a pulse to line 596 and AND gates 394 and 410 to the clock inputs of the flip-flops 398 and 412. If no flypiece is present at sensor 32 as indicated by a low on line 400 the operation of the sewing machine 26 and the flypiece tension mechanism 120 is terminated. If a flypiece is present at sensor 32 as indicated by a high on line 400, then both the flip-flops 398 and 412 remain set and the sewing machine 26 and flypiece tension mechanism 120 remain operating until terminated by sensing of the end of the flypiece.

The line 264 going low at the beginning of the countdown period is applied to the reset input of one shot 472 to disable the one shot 472 during the countdown and prevent further operation thereof by signals from line 240.

In the event that the sensor 84 has detected the end of the slide fastener chain 22 from the reel 72, the line 240 remains low and the flip-flop 478 is not reset. Thus, the normal output of the flip-flop 478 applied to the reset input of the one shot 580 will be high enabling the one shot 580 to be operated at the end of the coundown signal on line 264. The pulse from the one shot 580 at the end of this countdown period is applied by line 586 and NAND gates 436 and 456 to the reset inputs of the flip-flops 398 and 412 to terminate operation of the respective sewing machine 26 and tension mechanism 120. The low inverted output of the flip-flop 478 is applied to the reset input of the one shot 590 preventing its operation to restart the sewing machine and tension mechanism if a flypiece is present at the sensor 32. The normal output of flip-flop 478 on line 484 is high which through OR gate 486, inverter 488, and diodes 490 and 354 hold transistor 360 non-conductive and the conveyor 90 non-operative. Also, the inverted output of the flip-flop 578 is applied by line 564 to inverter 566 which renders the output of the inverter 566 high terminating conduction through diode 568. Thus, the base of transistor 574 is high to render the transistor 574 conductive and operate the lamp 298, FIG. 7, to indicate that the apparatus has stopped because of the absence of slide fastener chain.

After the operator has installed a new reel of slide fastener chain, the defect reset switch 222 is closed by the operator to produce a low logic level on line 226. As shown in FIGS. 8 and 9 the low logic level on line 226 produces a high on the output of inverter 626 which is applied by AND gate 632, OR gate 560 and OR gate 562 to the reset input of the flip-flop 478. Also, the output of the AND gate 632 is inverted by the inverter 634 and applied to AND gate 588 which applies this signal to one shot 590. At the termination of the operation of the reset switch, the one-shot 590 will be operated to restart the sewing machine 26 and tension mechanism 120 in the event that a flypiece is present at the sensor 32.

The employment of a single sensor for both detecting a splice and the end of reel in a slide fastener chain eliminates the need for separate sensors for these two conditions. Also, the splice detecting and automatic feed of a section of the slide fastener chain while the conveyor feeding of a flypiece is terminated prevents the sewing of a flypiece over a section of slide fastener chain containing the splice.

Since many modifications, changes in detail and variations can be made to the above described embodiment, it is intended that all matter in the foregoing description and shown in the accompanying drawings be interpreted as illustrative and not in a limiting sense.

What is claimed is:

1. A method of sewing flypieces onto a continuous slide fastener chain, comprising the steps of guiding a continuous slide fastener chain to a sewing station defined by a sewing machine;

sequentially feeding flypieces along a feed path to the sewing station by means of a conveyor;

sensing the presence and absence of a flypiece at a predetermined point in the feed path spaced in front of the sewing station;

operating the sewing machine in response to the sensing of the presence of a flypiece at the predetermined point;

said operating including advancing the flypieces and slide fastener chain through the sewing station, and sewing the flypieces to the slide fastener chain during the advancing;

terminating operation of the sewing machine in response to the sensing of the absence of a flypiece at the predetermined point;

said operating and said terminating each including delaying the operating and the terminating, respectively, of the sewing machine for selected durations after first sensing the presence and absence, respectively, of a flypiece at a predetermined point;

said advancing of the flypieces and the slide fastener chain through the sewing station being performed at a first linear feed rate; and said feeding of the flypieces to the sewing station by the conveyor being performed at a second linear feed rate which is less than the first linear feed rate whereby a predetermined uniform spacing is produced between flypieces sewn to the slide fastener chain.

2. A method as claimed in claim 1 wherein said second linear feed rate is in the range from 5% to 10% slower than the first linear feed rate.

3. A method as claimed in claim 1 including the further steps of sensing a splice in the slide fastener chain at a point spaced in front of the sewing station by a distance greater than the length of the flypieces, stopping the feeding of the flypieces and disabling the terminating of operation of the sewing machine for a duration sufficient to advance a length of slide fastener chain equal to the length of the flypieces plus the length of a splice through the sewing station in response to the sensing of a splice, and restarting the feeding of the flypieces and re-enabling the terminating of operation of the sewing machine after the stopping and disabling.

4. A method as claimed in claim 1 including the steps of sensing first and second conditions by means of a single sensor positioned at a point along a path of movement of the slide fastener chain and spaced in front of the sewing station by a distance greater than the length of the flypieces, said first condition being either a splice in the slide fastener chain or the absence of the slide fastener chain, said second condition being the presence of a non-spliced section of slide fastener chain, stopping the feeding of flypieces and disabling the termination of operation of the sewing machine for a duration sufficient to advance a length of slide fastener chain equal to the length of the flypieces plus the length of a splice through the sewing station in response to the sensing of the first condition, restarting the feeding and re-enabling the termination of the operation of the sewing machine after the stopping and disabling in response to the sensing of the second condition during the stopping and disabling, and terminating operation of the sewing machine if the first condition is maintained throughout the stopping and disabling.

5. A method as claimed in claim 1 including applying a frictional dragging force on the trailing portion of the flypiece during the advancing of the flypieces and slide fastener chain through the sewing station to hold the flypieces in alignment with the slide fastener chain.

6. A method as claimed in claim 1 wherein the sewing of the flypieces to the slide fastener chain includes forming a pair of lines of stitches; and wherein the method includes serging an edge of the flypieces simultaneously with the forming of the pair of lines of stitches.

7. An apparatus for feeding and sewing flypieces onto a continuous slide fastener chain, comprising a sewing machine defining a sewing station for advancing the flypieces and the slide fastener chain through the sewing station and for sewing the flypieces to the slide fastener chain during the advancing, means for guiding the continuous slide fastener chain to the sewing station, a conveyor in front of the sewing machine for sequentially feeding flypieces to the sewing station, sensing means for sensing the presence and absence of a flypiece at a predetermined point spaced in front of the sewing station, means controlled by the sensing means for operating the sewing machine in response to the presence of a flypiece at the predetermined point and for terminating operation of the sewing machine in response to the absence of a flypiece at the predetermined point, said operating and terminating means including delay means for delaying the operation and the terminating of operation for respective delay periods after an initial sensing of the presence and absence, respectively, of the flypiece by the sensing means, said sewing machine having a first linear feed rate of advancement of the flypieces and slide fastener chain through the sewing station, and said conveyor having a second linear feed rate of advancement of the flypieces which is less than the first linear feed rate whereby a predetermined uniform spacing is produced between adjacent flypieces sewn to the slide fastener chain.

8. An apparatus as claimed in claim 7 wherein the second linear feed rate is within the range from 5% to 10% slower than the first linear feed rate.

9. An apparatus as claimed in claim 7 including means for sensing a splice in the slide fastener chain at a second predetermined point spaced in front of the sewing station by a distance greater than the length of the flypieces, means for conveying and for maintaining the sewing machine operating for a duration sufficient to advance a length of slide fastener chain equal to the length of the flypieces plus the length of a splice through the sewing station by the advancing means in response to the splice sensing means sensing a splice, and means for restarting the conveyor and for disabling the maintaining of the sewing machine operating after the duration of the stopping and maintaining means.

10. An apparatus as claimed in claim 9 wherein said splice sensing means also operates in response to sensing of the absence of a slide fastener chain indicating the passing of the end of the slide fastener chain; the means for restarting the conveyor and for disabling the maintaining of the sewing machine operating includes means for preventing operation of the restarting of the conveyor in response to the sensing of either the splice or the absence of the slide fastener chain, and means for overriding the preventing means in response to the sensing of the presence of a slide fastener chain during the duration of the stopping and maintaining means.

11. An apparatus as claimed in claim 7 including flypiece tensioning means for engaging and tensioning a and the sewing station during operation of the sewing machine, said flypiece tensioning means including delay means responsive to the sensing means for operating the tensioning means.

12. An apparatus as claimed in claim 7 wherein the sewing machine includes dual straight stitch forming means for forming a pair of stitch lines attaching the flypieces to the slide fastener chain, and serging means for serging an edge of the flypieces simultaneously with the forming of the pair of stitch lines.

* * * * *